US009308634B1

(12) United States Patent
Adams

(10) Patent No.: US 9,308,634 B1
(45) Date of Patent: Apr. 12, 2016

(54) AIR BRAKE SERVICE TOOL

(71) Applicant: Perry Adams, Phelps, NY (US)

(72) Inventor: Perry Adams, Phelps, NY (US)

( * ) Notice: Subject to any disclaimer, the term of this patent is extended or adjusted under 35 U.S.C. 154(b) by 0 days.

(21) Appl. No.: 14/803,417

(22) Filed: Jul. 20, 2015

(51) Int. Cl.

| | |
|---|---|
| ***B25B 11/00*** | (2006.01) |
| ***B25B 27/30*** | (2006.01) |
| ***B25B 5/02*** | (2006.01) |
| ***B25B 5/16*** | (2006.01) |
| ***B25B 27/00*** | (2006.01) |
| *B25B 7/02* | (2006.01) |

(52) U.S. Cl.
CPC ..... *B25B 27/304* (2013.01); *B25B 5/02* (2013.01); *B25B 5/163* (2013.01); *B25B 27/0035* (2013.01); *B25B 7/02* (2013.01)

(58) Field of Classification Search
CPC ..... B25B 7/02; B25B 7/123; B25B 23/1427; B25B 23/1425; B25B 27/304; B25B 27/0035; B25B 5/163; B25B 5/02
USPC ..... 81/426, 478; 269/6, 268
See application file for complete search history.

(56) References Cited

U.S. PATENT DOCUMENTS

| | | | | |
|---|---|---|---|---|
| 2,681,791 | A * | 6/1954 | Hahn | B60T 17/221 254/131 |
| 4,169,395 | A * | 10/1979 | Hoskinson | B25B 7/22 81/421 |
| 4,499,796 | A * | 2/1985 | Miller | B25B 7/02 137/322 |
| 4,776,079 | A * | 10/1988 | Cameron | B25B 5/12 29/268 |
| 5,050,466 | A * | 9/1991 | Cameron | B25B 5/12 81/419 |
| 5,182,841 | A * | 2/1993 | Park | B25B 7/02 29/229 |
| 6,009,608 | A | 1/2000 | Peckham | |
| 6,029,964 | A * | 2/2000 | Bohl | B25B 5/163 269/166 |
| 6,290,219 | B1 * | 9/2001 | Barbosa | B25B 5/003 269/155 |
| 6,648,315 | B1 * | 11/2003 | Lee | B25B 5/068 269/166 |
| 6,708,966 | B1 * | 3/2004 | Troudt | B25B 5/067 269/249 |
| 7,104,166 | B1 * | 9/2006 | Wong | B25B 5/12 81/180.1 |
| 7,168,181 | B2 * | 1/2007 | Walchak | B25B 5/068 269/36 |
| 7,942,083 | B2 | 5/2011 | Jordan | |
| 2003/0141644 | A1 * | 7/2003 | Thomas | B25B 5/163 269/6 |

OTHER PUBLICATIONS

The Official Air Brake Handbook "Air brake chambers" retrieved from http://www.mto.gov.on.ca/english/handbook/airbrake/section3-4-0.shtml, Last modified: Aug. 27, 2013, 3 pages.
The Official Air Brake Handbook "Spring brakes for emergency braking and parking" retrieved from http://www.mto.gov.on.ca/english/handbook/airbrake/section4-1-0.shtml, Last modified: Aug. 27, 2013, 2 pages.
The Official Air Brake Handbook "Disabling the spring-brake chamber" retrieved from http://www.mto.gov.on.ca/english/handbool/airbrake/section4-2-0.shtml, Last modified: Aug. 27, 2013, 2 pages.

* cited by examiner

*Primary Examiner* — Hadi Shakeri
*Assistant Examiner* — Danny Hong
(74) *Attorney, Agent, or Firm* — Cesari and McKenna, LLP

(57) ABSTRACT

A tool for servicing air brake systems. The tool includes a sliding bar locking mechanism. On one end of the bar is a movable, lockable tubular member; on the other end is a fixed hook member. The tool permits one person working alone to quickly replace an air brake diaphragm.

6 Claims, 7 Drawing Sheets

AIR BRAKE SERVICE TOOL

BACKGROUND OF THE INVENTION

1. Field of the Invention

This patent application relates to air brakes and more particularly to a tool for holding air brake components in position on a vehicle during maintenance procedures.

2. Background Information

Air brake systems such as those used on semi-trailer trucks typically include one or more air brake assemblies at each wheel. Certain tools are already known for assembling or servicing brake chambers. U.S. Pat. No. 4,776,079 describes a clamping tool for supporting a handbrake while slowly releasing it against the action of a compression spring. This tool serves to securely hold together the brake can and brake drum during repair procedures. The tool includes a pair of handles that pivot with respect to one another and a pair of clamping arms carried by the handle members. One of the clamping arms includes an adjustable support leg.

U.S. Pat. No. 6,009,608 describes a device for reassembling a brake system. The device includes a pair of jaws extending outwardly from vice grip type pliers. The upper jaw section has a notch cut out of one end for supporting an upper end of a brake chamber casing. The lower jaw section has an aperture for receiving a lower end of a casing shaft.

U.S. Pat. No. 7,942,083 describes a C-clamp locking device especially adapted to depress brake drum springs while brake shoes are replaced. This tool includes a pair of opposing jaws, with a first jaw having a ring disposed perpendicular to a blunt second jaw. Vice-grip type handle portions are used. This tool, while useful in repairing drum brakes, is not particularly helpful in servicing air brake chambers.

It is recognized that the safety precautions must be taken when working on or around brake chambers.

The purpose of a service brake is to convert the air pressure force generated when the driver steps on the brake pedal into a mechanical push rod action to engage brake shoes or pads.

A typical air brake assembly includes a housing (or chamber) with a diaphragm arranged to activate a push rod when air enters the chamber from an inlet. Air pressure is hydraulically controlled via a brake pedal accessible to the driver. A return spring helps to expel the air and return the push rod to its withdrawn position when air pressure is released. A vehicle's front brake chamber thus includes a housing assembly and diaphragm enclosed within a two-piece housing, the push rod return spring, and a band clamp which holds the two-pieces of the housing together.

A rear brake chamber is similar, but can be more complicated, because it often has two chambers, one for the service brake and another for an emergency or parking brake.

The emergency/parking brake utilizes a spring brake mechanism. The spring brake mechanism is not controlled by the same compressed air system as the service brakes. The spring brake is applied when air pressure leaves the brake chamber and releases when air pressure builds up in the chamber. Spring brake chambers work by means of a large coil spring that provides enough force to hold the brakes in the applied position instead of air. The spring brake section is, in effect, piggybacked onto a service brake section but these two sections function as two separate systems.

SUMMARY

Statement of the Problem

Air brake systems typically provide little warning of the need for repair. Their demise is usually a sudden event, accomplished by agonizing sound of escaping air. While broken springs can seem to account for some catastrophic failures, it is more common for a leaking diaphragm to require immediate repair while the truck is on the road. Usually the air brake chamber failure starts when one of the internal springs, fatigued by repeated application and rust introduced by road chemicals, breaks into several pieces. This condition then goes unnoticed because the remaining brakes continue work just fine. Eventually, however, the jagged broken parts poke a hole in a diaphragm (also called a "pancake"). This can lead to an expensive and time consuming roadside repair.

Thus there is a need to replace an air brake diaphragm as quickly as possible while on the road, by one person working alone, and preferably without having to remove the air brake from the vehicle. Since opening the brake chamber can be hazardous, it can be quite awkward to service brake chambers outside of a workshop with standard tools.

Accordingly, there is presented herein a new tool used for servicing an air brake. The tool includes a sliding bar clamp having a movable jaw at one end. The movable jaw can be lockably positioned along the bar by activating a ratcheting handle. A tube is attached to the movable jaw and engages an anchor bolt on an outboard end of the air brake. A hook member is fixed to the other end of the bar to engage a push rod of the air brake. The hook end may be reversible by repositioning fasteners or via a swivel. With the tool in place, a band clamp can now be safely removed. Releasing the moveable jaw allows separating the parts of the housing to access and replace the diaphragm. Ratcheting the movable end closed again realigned the housing parts, enabling the band clamp to be refastened.

BRIEF DESCRIPTION OF THE DRAWINGS

The invention description below refers to the accompanying drawings, of which.

DETAILED DESCRIPTION OF PREFERRED EMBODIMENTS

Figure 1:
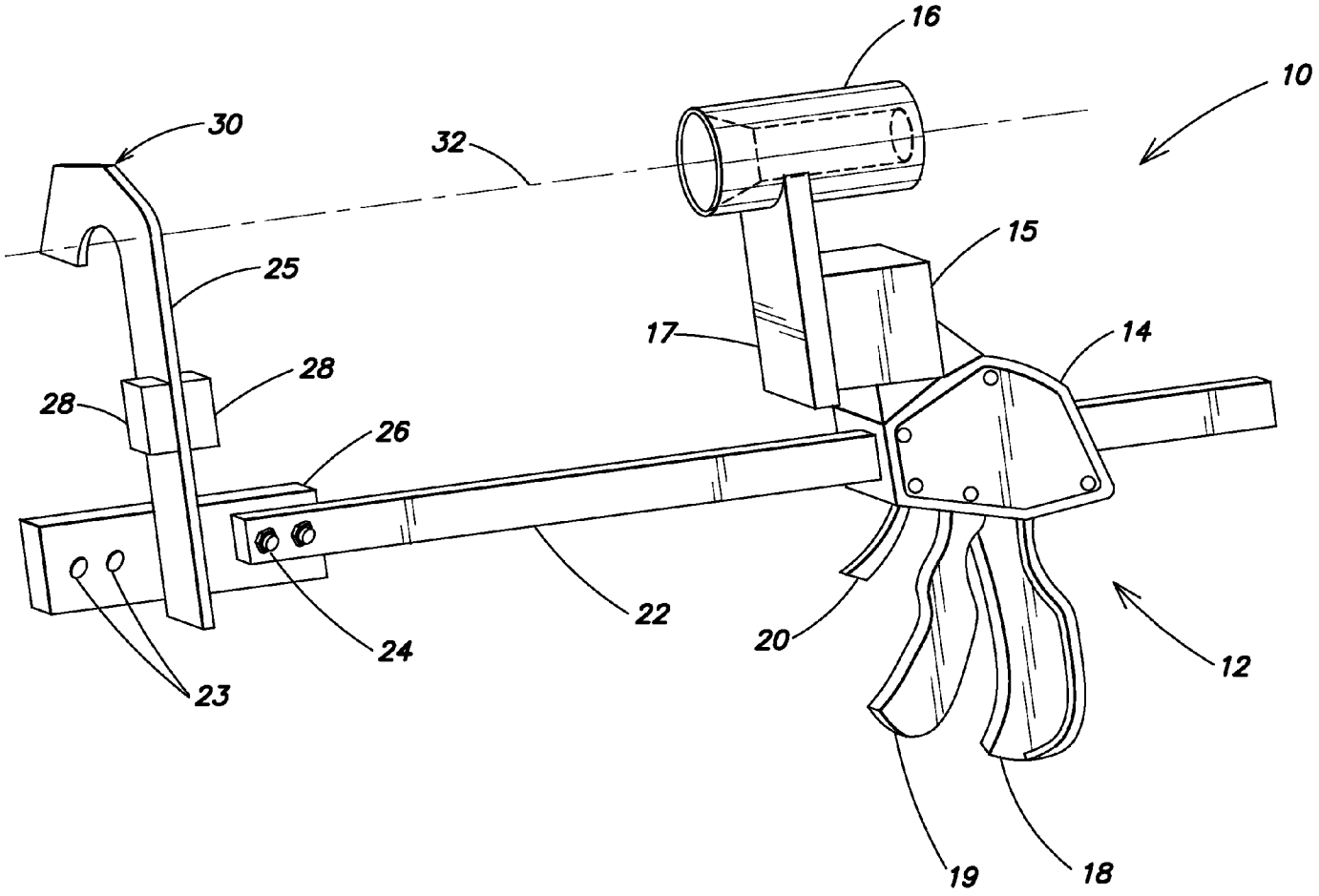
FIG. 1 is a perspective view of an air brake diaphragm service tool.

FIG. 1 shows a perspective view of an air brake service tool. The tool is used to disassemble and then reassemble an air brake chamber while the air brake remains on the vehicle. The tool is especially adapted for orderly removal of a band clamp, housing disassembly, swapping out the pancake diaphragm, reassembly of the housing, and reattachment of the band clamp. The tool avoids the need to support an inboard end of the air brake camber with a second pair of hands or a jack or some other arrangement.

More particularly, the tool 10 consists of a Quick-Grip® style clamp mechanism 12, including a head (or jaw) 14, handle 18, trigger 19, and release 20. Utilizing handle 18 and release 20 the head 14 is freed to slide back and forth along a bar 22. Head 14 includes a structure 17 serving to support a tubular head 16.

On the end of arm 22 opposite tubular head 16 is a reversible anchor hook assembly 30. Hook assembly 30 consists of hook portion 25 and base portion 26. Base portion 26 has a number of threaded holes 23 adapted to engage fasteners 24. The holes 23 and fasteners 24 enable the hook 25 to be reversed 180° from the position shown in FIG. 1. Also on either side of hook 25 are standoffs 28. The standoffs 28 help position the tool 10 on the brake chamber housing as will be shown in other figures and described below.

The position of the tubular head 16 can be adjusted left or right along bar 22 and locked into place by operating clamp handle trigger mechanism 19. Clamp mechanism may operate in a manner such as a ratcheting clamp known as a Quick-Grip® clamp. Such clamps available from Irwin Tools®, or the E-Z Hold® clamps from Jorgenson®, or other similar products may be suitable. Still other types of bar clamps, pipe clamps and other may be used as long as they provide a jaw that can be moved along the bar and clamped in position.

Figure 2:
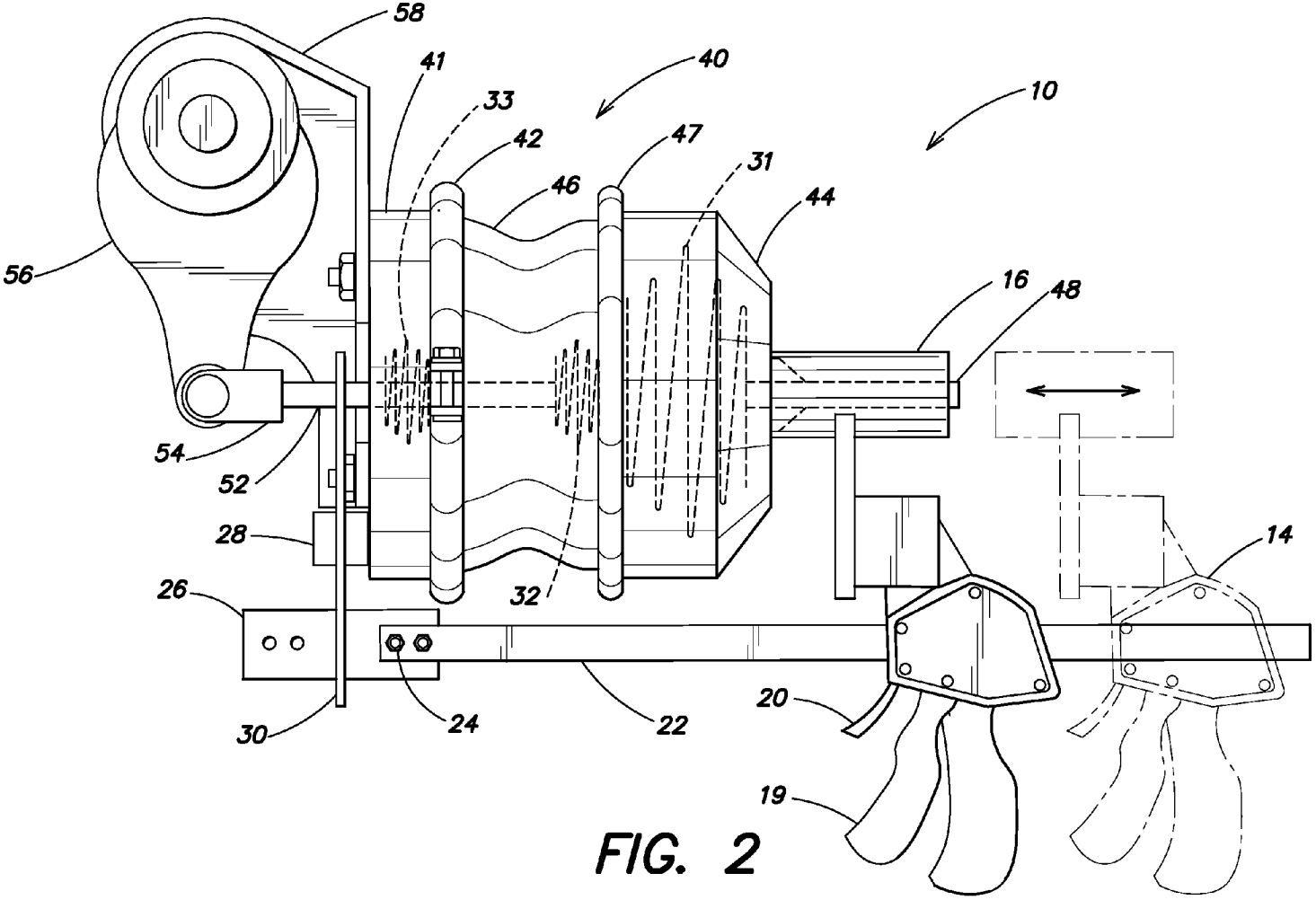
FIG. 2 is a plan view of the tool being attached to a brake chamber on a vehicle.

FIG. 2 shows the tool 10 in an initial position after being attached to an air brake chamber 40. The air brake chamber 40 remains in place on a vehicle such as attached to the vehicle by bracket 58. The air brake assembly 40 consists of a housing base 41 and emergency and/or parking brake spring housing 47. In operation of the service brake, a cam is rotationally activated when the brake pedal is depressed, to move a slack adjuster 56 and yoke 54 and in turn move push rod 52 outwards. This causes a diaphragm (positioned internal to housing 41 and not visible in FIG. 2) to cause a shoe or pad to engage a service brake drum or disk (not shown). Return springs 32 and/or 33 return the diaphragm to its unloaded position when the brake pedal is released and push rod 52 retracted.

Also shown in FIG. 2 is that a spring anchor safety bolt 48 has been inserted into the housing 44. The anchor safety bolt 48 is used to pull back a coil spring portion 31 of the emergency brake during servicing. In particular, the anchor safety bolt 48 is threaded in the outboard end of housing 44 to engage the parking/emergency brake coil spring 31 thus releasing it from tension. This then enables service personnel to safely release fasteners 43 on service brake clamp 42 to access the diaphragm inside the housing.

To use the tool 10 to service the diaphragm, the tool 10 is placed on air brake 40 assembly such that the inner arch of hook 30 is placed over the top of push rod 52. The tubular end 16 is then aligned with the anchor bolt 48. The Quick-Grip® clamp 12 is then tightened by operating trigger 19 causing ratcheting head 14 to move tubular member 48 towards the left. This in turn causes tubular member 16 to enclose the anchor bolt 48 and eventually press against the outboard face 44 of spring brake housing 47.

Thus with the tool 10 now firmly engaging the parts of air brake assembly 40, the user can safely and easily access the inside of the housing by unfasten the two-piece band clamp 42 such as by loosening threaded fastener(s) 43.

The ability to swap the hook from one orientation to the opposite orientation is useful since the orientation of the tool 10 needs to be different on the left and right sides of the vehicle. In particular, the hook end 30 is placed adjacent the push rod 52 portion of the air brake which is typically located on the inboard side of the air brake 40. The tubular end 16 also engages an anchor bolt 48 that is always on the outboard end of the air brake regardless of the side of the vehicle being serviced.

Figure 3:
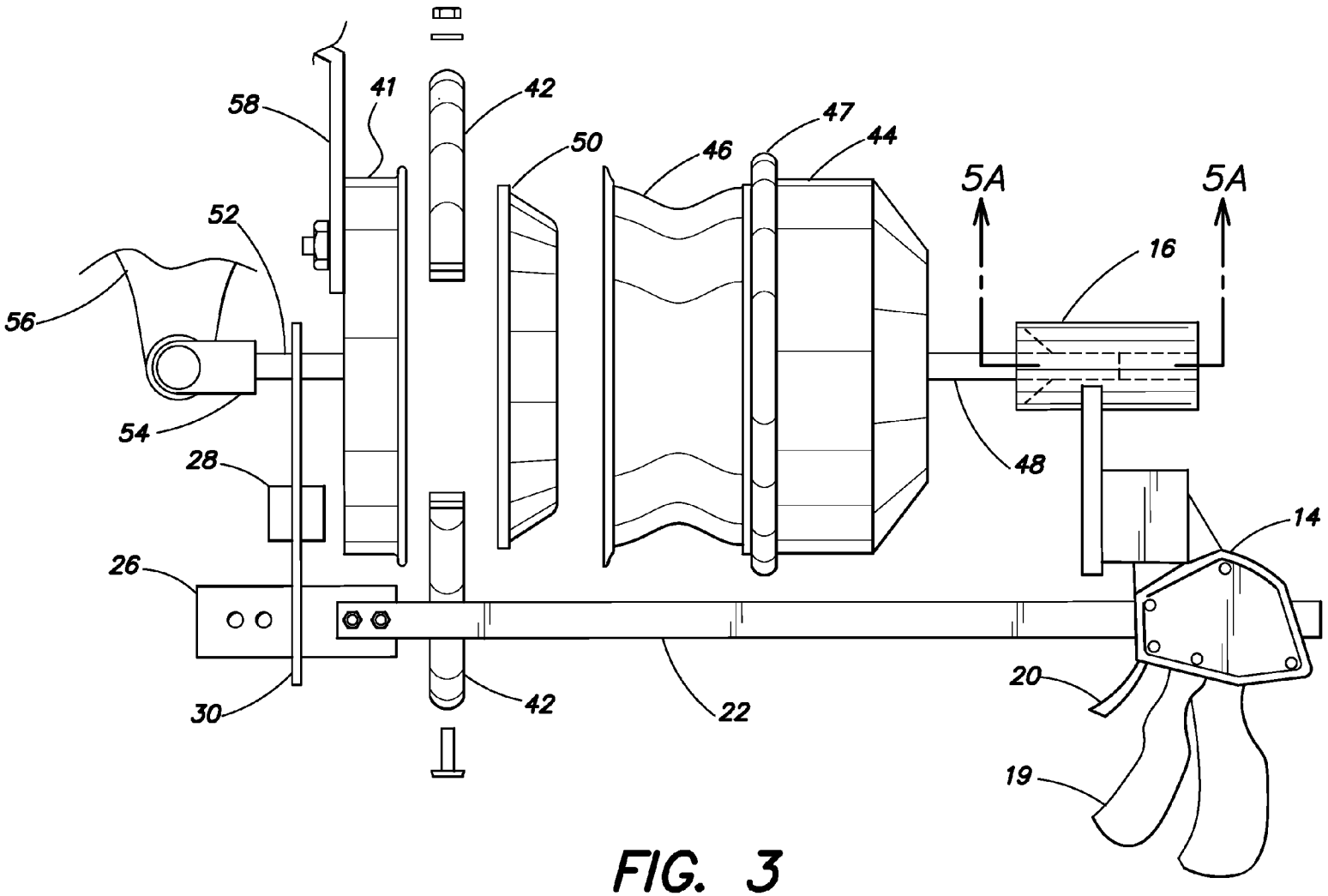
FIG. 3 is another view of the tool and brake chamber after a jaw of the tool has been released to open a housing clamp to access the air brake diaphragm.

FIG. 3 shows the tool 10 and air brake 40 after the two-piece clamp 42 is removed enabling the housing sections to be opened. Here the head 14 has been now disengaged from bar 22 using release handle 20 allowing the housing sections 40 and 46 to be separated. This allows the user to now remove and replace diaphragm 50. In this position, with the standoff 28 held in place against the outward face of housing base 41, push rod 52 still serves as a place to support hook 30. The inner portion of tubular head 16 also still engages and supports the other side of air brake via anchor safety bolt 48. This allows a single user of tool 10 to easily access diaphragm 50 while ensuring that the other relatively heavy components such as base 40, housing midsection 46, and so forth remain more or less aligned along an axis parallel to bar 22 for ease of reassembly.

Figure 4:
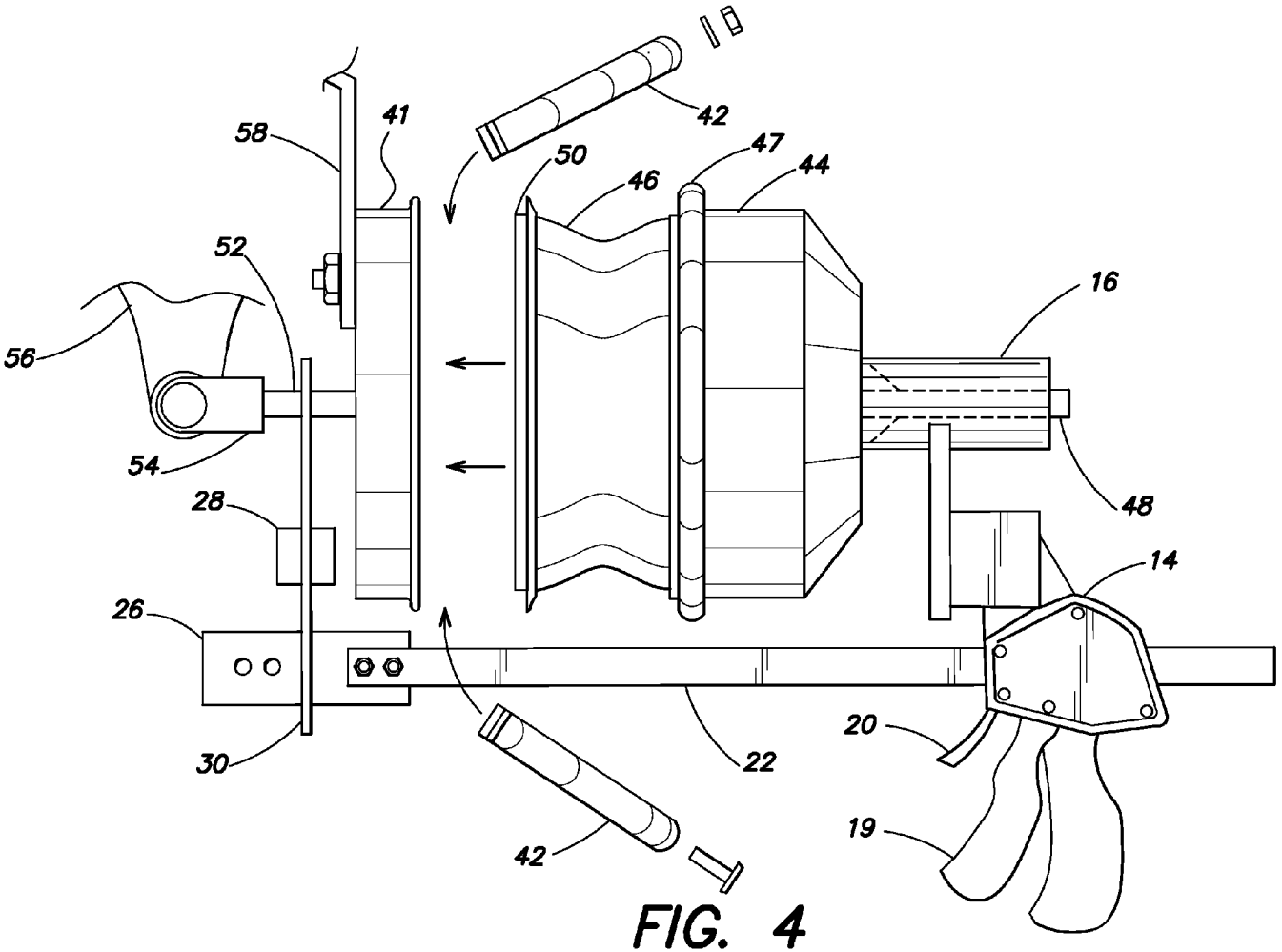
FIG. 4 is a view showing reassembly of the brake chamber.

FIG. 4 illustrates reassembly of the air brake chamber 40 using tool 10. Diaphragm 42 is replaced in position between housing base 40 and midsection 46. Trigger 19 is then again engaged to move ratchet head 14 to the left, causing tubular portion 16 to again fit snugly against face 44 of section 46, and for hook 30 and inner standoff 28 to press against housing base 40. The two pieces of the band clamp 42 can then be reattached to the housing sections by tightening fastener(s) 43.

It can now be understood that while tools in the prior art may assist with assembly of air chambers on a workbench, they do not provide much assistance with an "on the truck" repair that might be necessary to complete by a person working alone. An on-truck repair requires disassembly, swapping out the pancake and reassembly of the various pieces of the brake chamber in position against housing base while the service brake clamp is reattached ideally by just one person. The tool 10 described herein achieves this end.

The tool can also be used for other procedures. For example, along with use for replacement of the pancake diaphragm, it should also be noted that the tool 10 can be used to engage the air brake assembly for the replacement of the parking brake chamber 46. The parking brake subassembly is prone to fail independently of the service brake pancake.

Figure 5A:
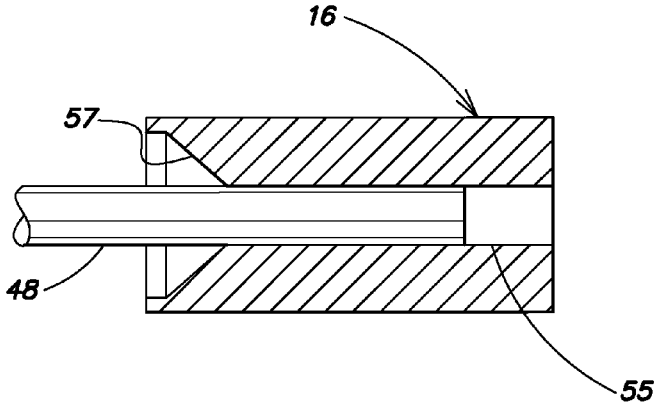
FIG. 5A is a detailed view of a tubular head end of the tool.

FIG. 5A is a detailed view of the tubular head 16. It is typically implemented as a hollow cylinder having an inner diameter wide enough to slide over anchor bolt 48 and yet small enough to hold tool 10 in place while the housings of the air brake chamber 40 are disassembled.

Figure 5B:
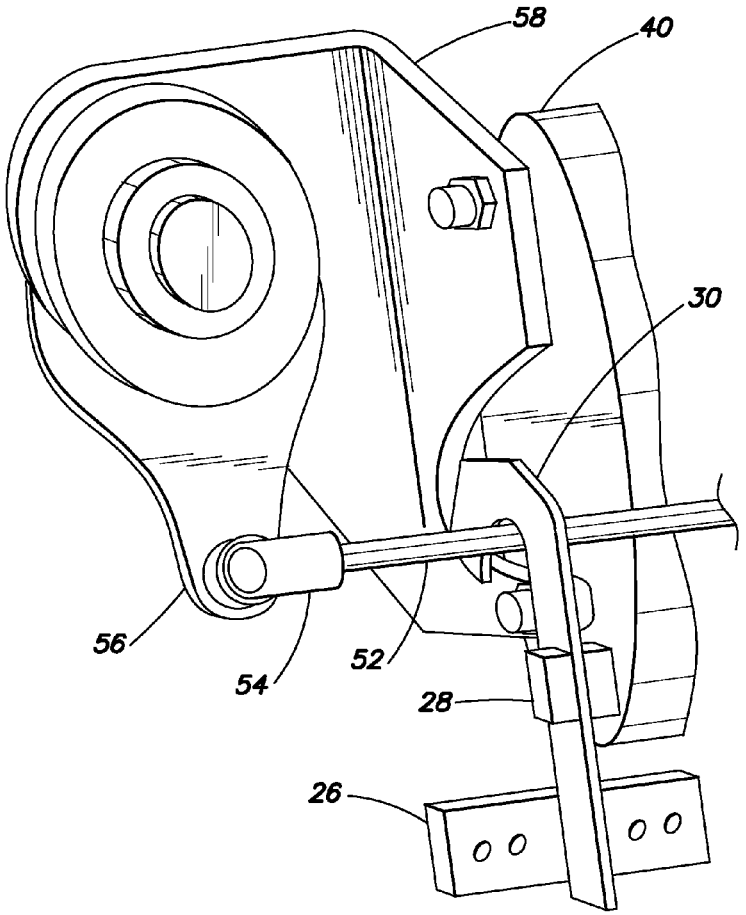
FIG. 5B is a detailed view of the hook end.

FIG. 5B is a more detailed view of the inner arch portion of hook end 30 placed against push rod 52. Also seen is the inboard standoff 28 pressing against the inboard face of housing base 40.

Figure 6:
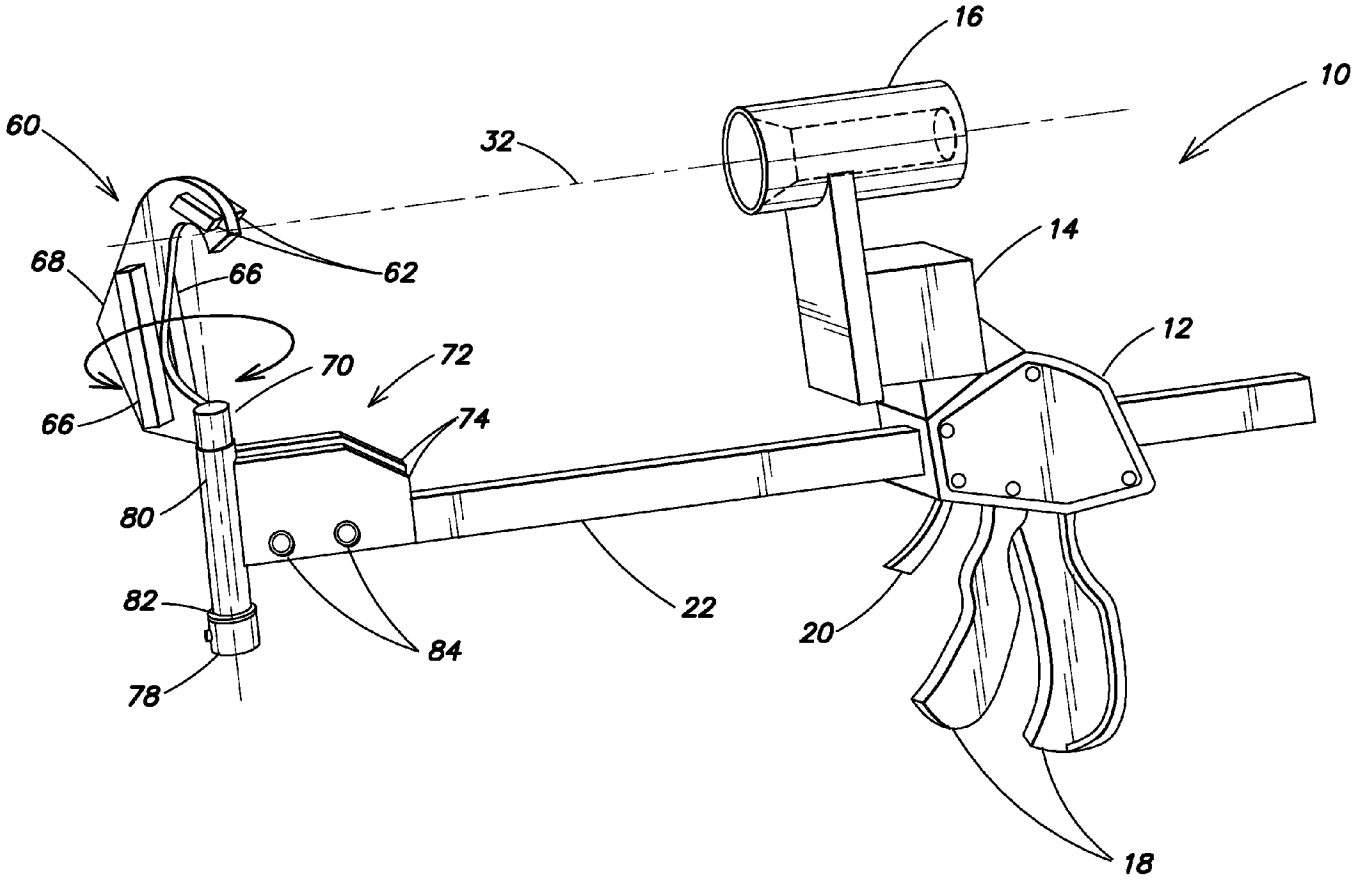
FIG. 6 shows an embodiment with a swivel hook.
Figure 7:
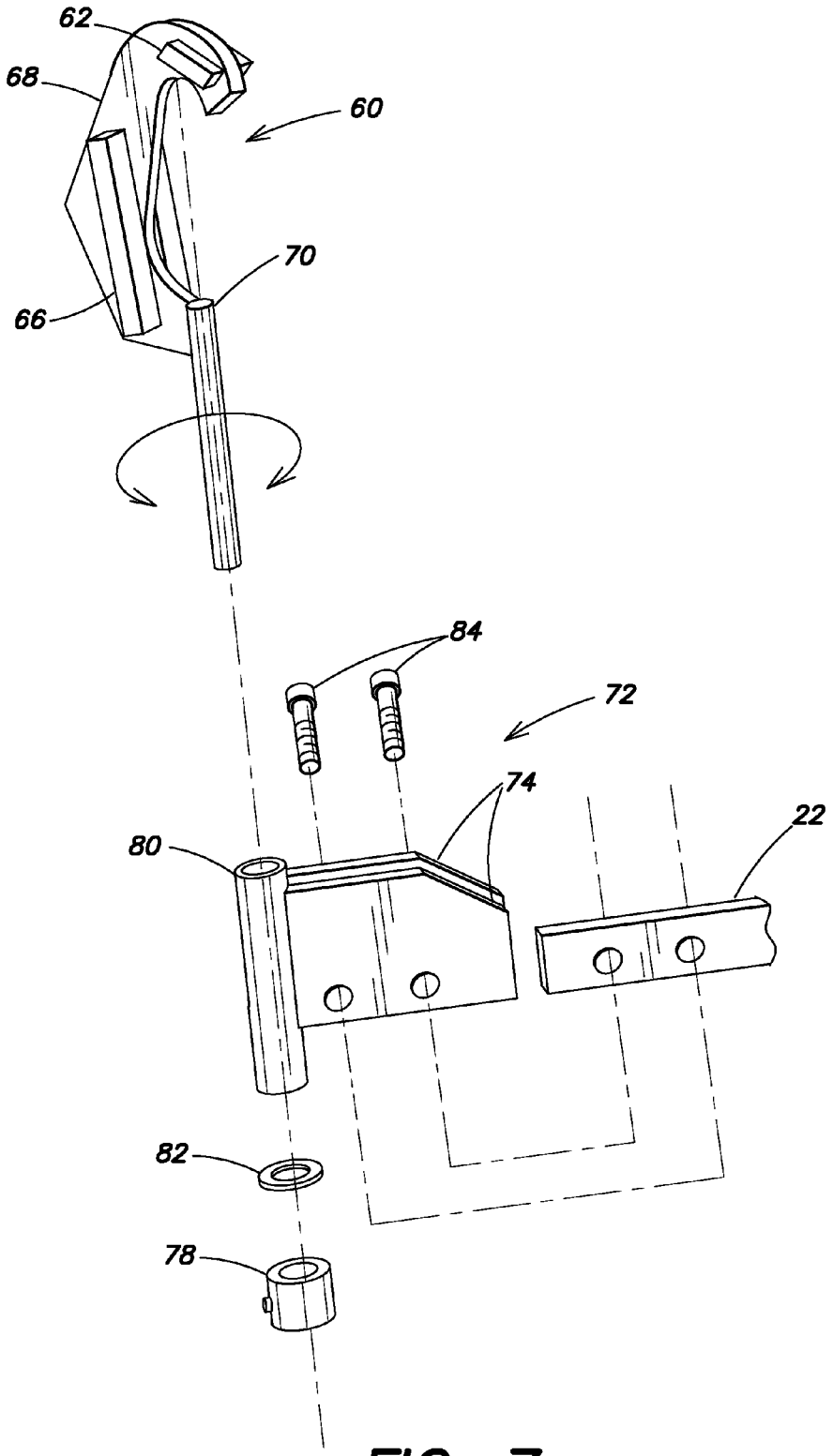
FIG. 7 is a more detailed view of the swivel hook components.

FIGS. 6 and 7 show an alternate embodiment of hook end 30 using a swivel arrangement to allow positioning the hook in either orientation. This swivel arrangement 72 consists of a pair of side plates 74 sandwiching either side of the bar 22. Fasteners 76 hold the side plates 74 in position threading into holes in the side plates 74.

A hollow tube 80 on the outboard end of side plates 74 holds shaft 70 with the attached hook 60. The centerline of the hook 60 (that is, the peak of the inner arch where the hook contacts the brake pushrod) and the swivel post presented at the centerline of hollow tube 80 should be designed to be directly in line with each other. With these in alignment, even pressure is kept on the on the assembly when clamping force is applied by tool 10.

Hook 60 is thus otherwise free to swivel about with shaft hollow tube 80. Washer 82 and locking collar 78 hold the shaft 70 in vertical position in tube 80. Standoffs 62 and 66 are placed on the swivel hook 60 serving the same function as the standoffs 28 in the fixed hook arrangement previously described in FIG. 1.

What is claimed is:

1. A brake chamber service comprising:

a sliding bar clamp including a ratcheting head configured to slide back and forth along a tool longitudinal axis, and lockably engage, a slide bar;

a tubular member coupled to the ratcheting head and disposed parallel to the axis of said slide bar, the tubular member having a first end with a first inner diameter and a second end with a second inner diameter, wherein the first inner diameter is larger than the second inner diameter; and a hook member fixed to an end of the slide bar opposite the ratcheting head, the hook member having a hook with inner radius larger than an outer diameter of a brake push rod; wherein the centerline of the arch of the hook member is aligned with a centerline of the tubular member.

2. The apparatus of claim 1 wherein the sliding bar clamp further includes a trigger, a release, and a handle, the release coupled to the ratcheting head so as to release the ratcheting head from engaging the slide bar when the release is activated.

3. The apparatus of claim 1 wherein the hook member is fixed to the slide bar with a reversible attachment plate and fastener.

4. The apparatus of claim 1 wherein the hook member is fixed to the slide bar with a pivoting attachment.

5. The apparatus of claim 1 wherein the pivoting attachment further comprises:

a cylinder attached to the slide bar;

a shaft enclosed within the cylinder with one end attached to the hook member; and a locking collar attached to an end of the shaft opposite the hook member.

6. The apparatus of claim 1 further comprising:

a pair of standoffs disposed on either side of the hook member, the standoffs positioned so as to contact a housing surface of the brake chamber when the hook is placed on the brake chamber push rod.

* * * * *